US010370895B2

(12) United States Patent
Bertovic

(10) Patent No.: US 10,370,895 B2
(45) Date of Patent: Aug. 6, 2019

(54) LIGHTWEIGHT HIGH TECH DOOR

(71) Applicant: INTER-JOIN PTY LTD, Villawood, New South Wales (AU)

(72) Inventor: Tomo Bertovic, Villawood (AU)

(73) Assignee: INTER-JOIN PTY LTD, Villawood, NSW (AU)

( * ) Notice: Subject to any disclaimer, the term of this patent is extended or adjusted under 35 U.S.C. 154(b) by 0 days.

(21) Appl. No.: 15/770,732

(22) PCT Filed: Oct. 26, 2016

(86) PCT No.: PCT/AU2016/000364
§ 371 (c)(1),
(2) Date: Apr. 24, 2018

(87) PCT Pub. No.: WO2017/070727
PCT Pub. Date: May 4, 2017

(65) Prior Publication Data

US 2018/0320435 A1 Nov. 8, 2018

(30) Foreign Application Priority Data

Oct. 26, 2015 (AU) ..... 2015101579

(51) Int. Cl.
*E06B 3/70* (2006.01)

(52) U.S. Cl.
CPC ..... *E06B 3/7015* (2013.01); *E06B 3/70* (2013.01); *E06B 3/7003* (2013.01); *E06B 3/7005* (2013.01); *E06B 2003/703* (2013.01); *E06B 2003/7019* (2013.01); *E06B 2003/7023* (2013.01); *E06B 2003/7051* (2013.01)

(58) Field of Classification Search
CPC ..... E06B 3/70; E06B 3/7003; E06B 3/7005; E06B 3/7015; E06B 2003/7019; E06B 2003/7023; E06B 2003/703; E06B 2003/7051
See application file for complete search history.

(56) References Cited

U.S. PATENT DOCUMENTS 1,118,265 A * 11/1914 Q ..... E06B 3/728 52/455
2,506,978 A * 5/1950 Unterberger ..... E06B 3/00 160/180
2,927,354 A * 3/1960 Lauer ..... E06B 3/222 49/34
3,121,264 A * 2/1964 Hammar ..... E06B 3/825 49/501

(Continued)

FOREIGN PATENT DOCUMENTS

CN 202530964 U 11/2012
FR 2568622 A1 2/1986

(Continued)

*Primary Examiner* — James M Ference
(74) *Attorney, Agent, or Firm* — Craft Chu PLLC; Andrew W. Chu

(57) ABSTRACT

A door includes a sandwich panel having first and second panels, and a honey comb core. The first and second panels have edge tabs foldable toward one another. There are inner frame sections disposed at edge sections of the sandwich panel and adjacent to the honey comb core and inwardly of the edge tabs. The edge tabs are folded toward one another over the inner frame sections.

7 Claims, 12 Drawing Sheets

(56) References Cited

U.S. PATENT DOCUMENTS 3,271,919 A * 9/1966 Olton ..... E06B 3/88 52/717.01
3,410,040 A * 11/1968 Biro ..... E06B 3/302 52/222
3,455,078 A * 7/1969 Brown ..... E06B 3/827 49/503
3,786,613 A * 1/1974 Shepheard ..... E06B 3/827 52/309.9
4,238,909 A * 12/1980 Mutton ..... E06B 3/9885 403/402
4,509,294 A * 4/1985 Boilard ..... E06B 3/9845 49/504
4,589,240 A * 5/1986 Kendall ..... E04C 2/292 49/501
4,686,806 A * 8/1987 Bennett ..... E06B 3/7017 52/309.4
4,819,383 A * 4/1989 McKann ..... E06B 3/827 49/501
4,888,918 A * 12/1989 Green ..... E06B 5/16 49/501
4,896,458 A * 1/1990 McKann ..... E06B 3/827 49/501
4,937,978 A * 7/1990 Johansson ..... E06B 3/827 49/367
5,018,263 A * 5/1991 Stern ..... B21D 35/00 160/371
5,293,726 A * 3/1994 Schick ..... E06B 3/7001 52/455
5,448,872 A * 9/1995 Thompson ..... E04C 2/08 52/309.9
5,839,252 A * 11/1998 Berghorn ..... E06B 3/822 52/784.13
5,934,030 A * 8/1999 McDonald ..... E06B 1/30 49/505
6,098,368 A * 8/2000 McKann ..... E04C 2/292 52/784.13
6,132,540 A * 10/2000 Barber ..... E06B 3/7001 156/242
6,311,454 B1 * 11/2001 Kempel ..... E06B 3/76 52/309.11
6,694,702 B2 * 2/2004 Weymer ..... B23K 26/26 52/784.1
6,866,081 B1 * 3/2005 Nordgard ..... E06B 3/22 160/371
7,043,886 B1 * 5/2006 Chubb ..... A47F 3/0434 312/138.1
7,121,004 B1 * 10/2006 Shoup ..... E06B 9/04 29/897.312
7,244,328 B1 * 7/2007 Robbins, Sr. ..... E06B 3/82 144/346
7,617,606 B2 * 11/2009 Robbins, Sr. ..... E06B 3/82 156/254
7,823,353 B2 * 11/2010 Lynch ..... B27N 3/08 52/455
8,341,920 B2 * 1/2013 Tavarez ..... E06B 3/76 52/792.1
9,016,030 B1 * 4/2015 Steele ..... E06B 3/726 52/784.11
2001/0003889 A1 * 6/2001 Zen ..... E06B 3/822 52/784.1
2003/0084639 A1 * 5/2003 Wang Chen ..... E06B 3/825 52/784.1
2003/0140587 A1 * 7/2003 Smith ..... E06B 3/725 52/455
2003/0200714 A1 * 10/2003 Minke ..... B28B 1/14 52/423
2009/0038261 A1 * 2/2009 Lee ..... E06B 3/7017 52/784.11
2012/0272601 A1 * 11/2012 Mouskis ..... E06B 3/7003 52/458
2016/0145935 A1 * 5/2016 Bertovic ..... E06B 3/827 52/309.4
2018/0320435 A1 * 11/2018 Bertovic ..... E06B 3/7015

FOREIGN PATENT DOCUMENTS

GB 2268213 A 1/1995
WO 2014197945 A1 12/2014

* cited by examiner

LIGHTWEIGHT HIGH TECH DOOR

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a door and in particular to method of forming a door that is formed entirely out of a single lightweight pre-fabricated aluminium honeycomb core panel.

2. Description of Related Art Including Information Disclosed Under 37 CFR 1.97 and 37 CFR 1.98

Door construction has remained the same for many years. One form comprises a perimeter structural timber frame, with a core made from honeycomb or other lightweight cardboard material. This construction provides rigidity whist being relatively light. The inner core material is typically covered with timber veneer or MDF panels that are suitable for staining or painting. In recent years, pre-finished material has been used for door surfaces, however by way of construction, the door ends are exposed in the raw state requiring further finishing.

By way of installation, all doors have only three visible surfaces, being the internal face of the door from inside the room, the external face from outside the room and the latched face. The top of the door and the bottom of the door are never visible on an installed door.

The present invention seeks to overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

BRIEF SUMMARY OF THE INVENTION

According to a first aspect, the present invention provides a door comprising:

a sandwich panel comprising a first panel, a second panel, and a honeycomb core extending between inner surfaces of the first and second panels, the first and second panels having edge tabs foldable towards each other, inner frame sections disposed at edge sections of the sandwich panel adjacent the honeycomb core and inwardly of the edge tabs, and wherein the edge tabs are folded towards each other over the inner frame sections.

In a preferred embodiment, fold grooves are formed into the inner surfaces of the first and second panels at the edge sections thereof, the fold grooves being spaced inwardly from edges of the first and second panels and defining the edge tabs in the first and second panels.

In another preferred embodiment, each inner frame section comprises an elongated C-section beam having a central portion and upper and lower flanges, wherein the upper and lower flanges are disposed in the honeycomb core adjacent the respective first and second panels, and the central portion extends perpendicularly between the first and second panels slightly inwardly of the fold grooves.

In another preferred embodiment, the door comprises an inner frame sections comprise a hinge frame section, a latch frame section, and top and bottom frame sections.

In another preferred embodiment, the frame sections comprise mitred cut ends to meet at the corners of the door and to form an inner perimeter frame.

In another preferred embodiment, the edge tabs meet in a contiguous manner at a centre width line of the door.

In another preferred embodiment, the edge tabs comprise hinge tabs, latch tabs, upper tabs and lower tabs.

In another preferred embodiment, the latch plate tabs comprise latch deformation outlines and a latch cutout opening, wherein the deformation outlines are punched and deformed into both latch tabs to provide a recess to house a latch plate.

In another preferred embodiment, the corners of the first and second panels include shaped cut outs to provide contiguous folded edges.

In another preferred embodiment, hinge holes are formed in the hinge tabs, with hinges joining the hinge tabs to each other.

In another preferred embodiment, the hinges are attached to the inner frame section at the hinge edge.

In another preferred embodiment, the inner frame section for the latch edge comprises a step in the central portion thereof, wherein latch edge tabs of the honeycomb core cover the step.

In another preferred embodiment, the first and second panels are made from rectangular aluminium sheets.

In another preferred embodiment, the honeycomb core is made from aluminium, polyurethane foam, or polystyrene.

The present invention also provides a method of forming the door, the method comprising:

providing a sandwich panel comprising a first panel, a second panel, and a honeycomb core extending between inner surfaces of the first and second panels, the first and second panels having edge tabs foldable towards each other, inserting inner frame sections at edge sections of the sandwich panel adjacent the honeycomb core and inwardly of the edge tabs, and folding the edge tabs are towards each other over the inner frame sections.

In another preferred embodiment, each inner frame section comprises an elongated C-section beam having a central portion and upper and lower flanges, the method comprising removing honeycomb material for inserting the upper and lower flanges therein.

Other aspects of the invention are also disclosed.

BRIEF DESCRIPTION OF THE SEVERAL VIEWS OF THE DRAWINGS

Notwithstanding any other forms which may fall within the scope of the present invention, preferred embodiments of the present invention will now be described, by way of examples only, with reference to the accompanying drawings.

DETAILED DESCRIPTION OF THE INVENTION

Figure 1:
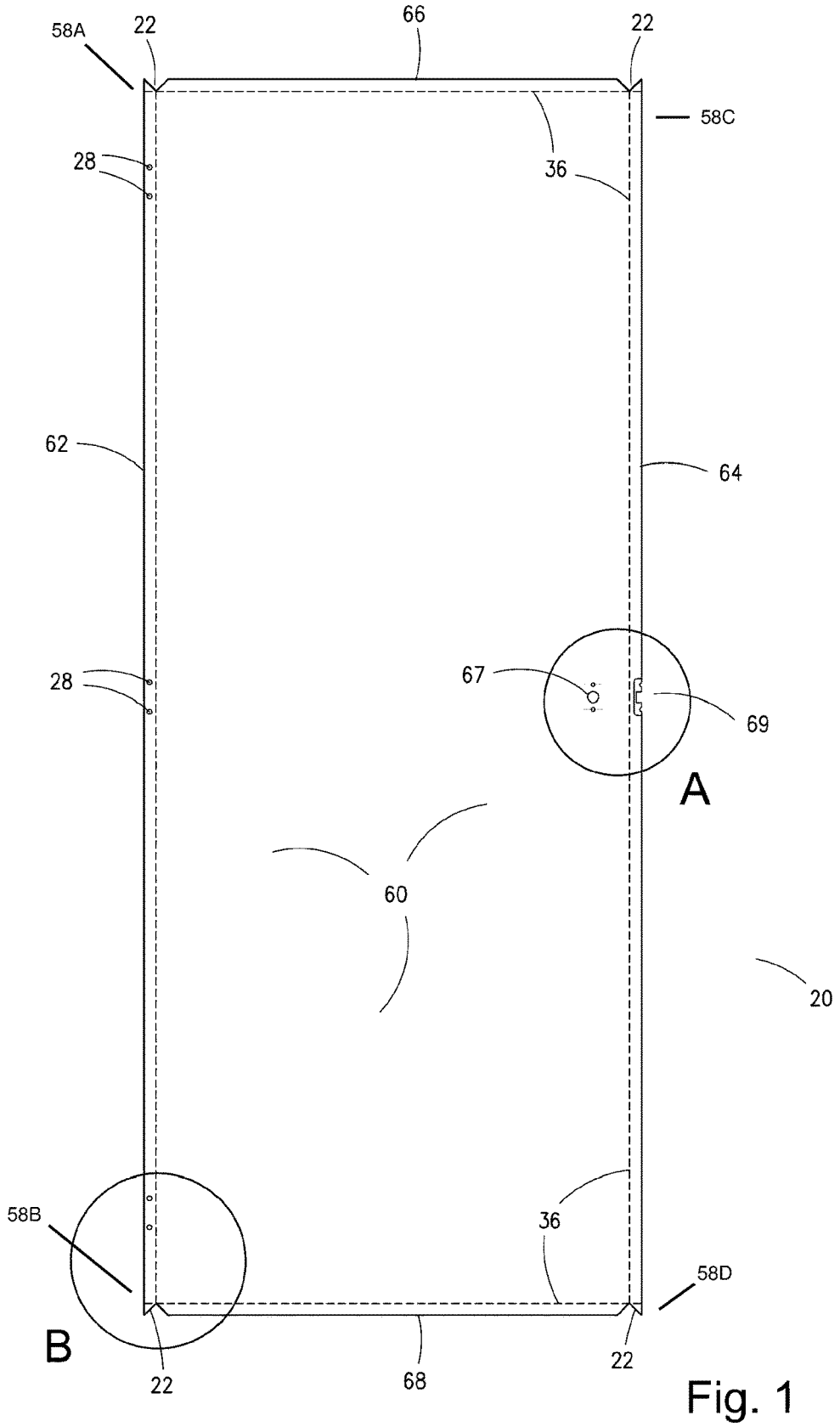
FIG. 1 is a front elevation view of a honeycomb core panel showing cut and grooved lines.

It should be noted in the following description that like or the same reference numerals in different embodiments denote the same or similar features.

FIG. 1 shows a front view of a pre-finished aluminium honeycomb core panel 20 for a door 100 according to a preferred embodiment of the present invention.

Figure 2:
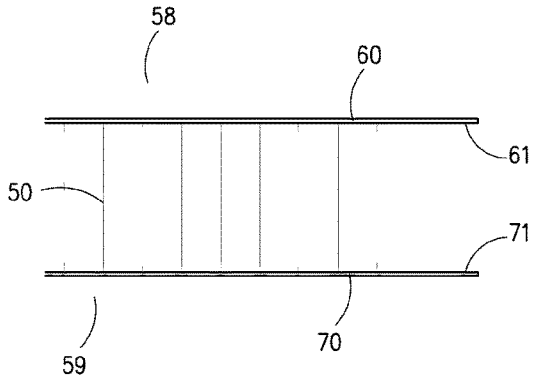
FIG. 2 is a cross-sectional view through the honeycomb core panel, showing the honeycomb core sandwiched between first and second aluminium sheets.

As shown in FIG. 2, the panel is a sandwich panel 20 comprising a first panel 58, a second panel 59 and a honeycomb core 50 therebetween. The first panel 58 has an external surface 60 and an inner surface 61. The second panel 59 has an external surface 70 and an inner surface 71. The honeycomb core 50 extends between the inner surfaces 61 and 71 and has a plurality of edge sections, the plurality of edge sections being comprised of a hinge edge section 50A, a latch edge section 50B, an upper edge section 50C, and a lower edge section 50D. In the embodiment, the first and second panels 58 and 59 are made from rectangular aluminium sheets, slightly larger than the panel size of the door to be formed. The honeycomb core can be made from aluminium, polyurethane foam, polystyrene, or other suitable material.

There are V-shaped grooves 36, 36A, 36B are carved into the inner surfaces 61 and 71 of the first and second panels 58 and 59, at the edge sections thereof, to provide a guide for folding. The grooves 36 are spaced inwardly from edges of the first and second panels 58 and 59. The grooves 36 define edge tabs in the first panel 58, being a first hinge tab 62, a first latch tab 64, a first upper tab 66 and a first lower tab 68. The grooves 36 define edge tabs in the second panel 59, being a second hinge tab 72, a second latch tab 74, a second upper tab 76 and a second lower tab 78.

Figure 3:
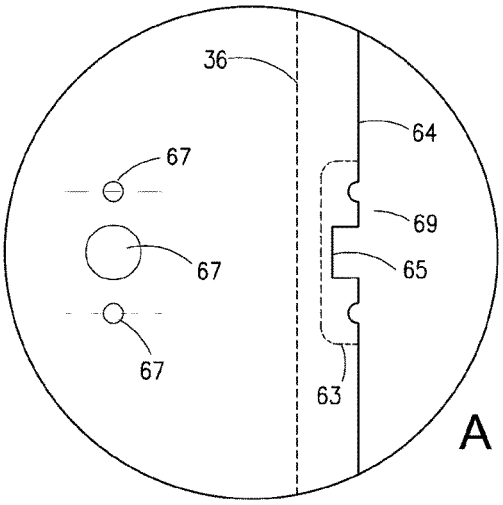
FIG. 3 shows the detailed sectional view of A in FIG. 1 of the door handle holes and latch plate cut out.

As shown in FIG. 3, door handle holes 67 are formed in mirrored locations of the first and second panels 58 and 59 close to the latch tabs 64. Latch plate details 69 are formed in the latch tabs 64 of the first and second panels 58 and 59. The latch plate detail 69 consists of deformation outline 63 and a latch cutout opening 65 being punched and deformed into both latch tabs 64 and 74 of the first and second panels 58 and 59.

Figure 4:
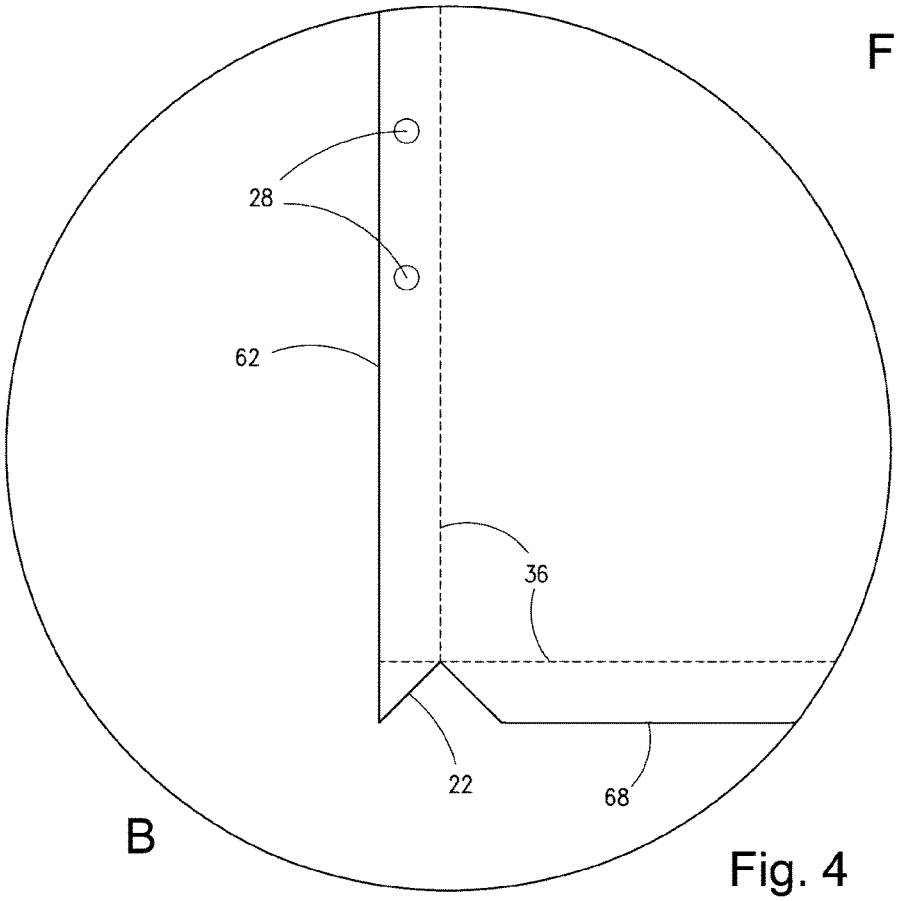
FIG. 4 shows the detailed sectional view of B in FIG. 1 of the grooved lines, cut lines and hinge hole locations.

As shown in FIG. 4, the corners (including a corner 58A between the first hinge tab and the first upper tab, a corner 58B between the first hinge tab and the first lower tab, a corner 58C between the first latch tab and the first upper tab, and a corner 58D between the first latch tab and the first lower tab in the first panel and a corner 59A between the second hinge tab and the second upper tab, a corner 59B between the second hinge tab and the second lower tab, a corner 59C between the second latch tab and the second upper tab, and a corner 59D between the second latch tab and the second lower tab in the second panel) of the first and second panels 58 and 59 include a triangle cut 22 and 'V grooves 36 carved into the inner surfaces 61 and 71 to provide folding guide lines. Spaced pairs of hinge holes 28 are formed in the hinge tabs 62 and 72, with the hinge holes 28 being mirrored in the first and second panels 58 and 59.

FIGS. 5 to 12 show the steps in forming the door 100, in particular the steps in the insertion of the inner frame sections 40 to the edge section of the honeycomb core panel 50 and panel folds over the inner frame sections 40.

Figure 11:
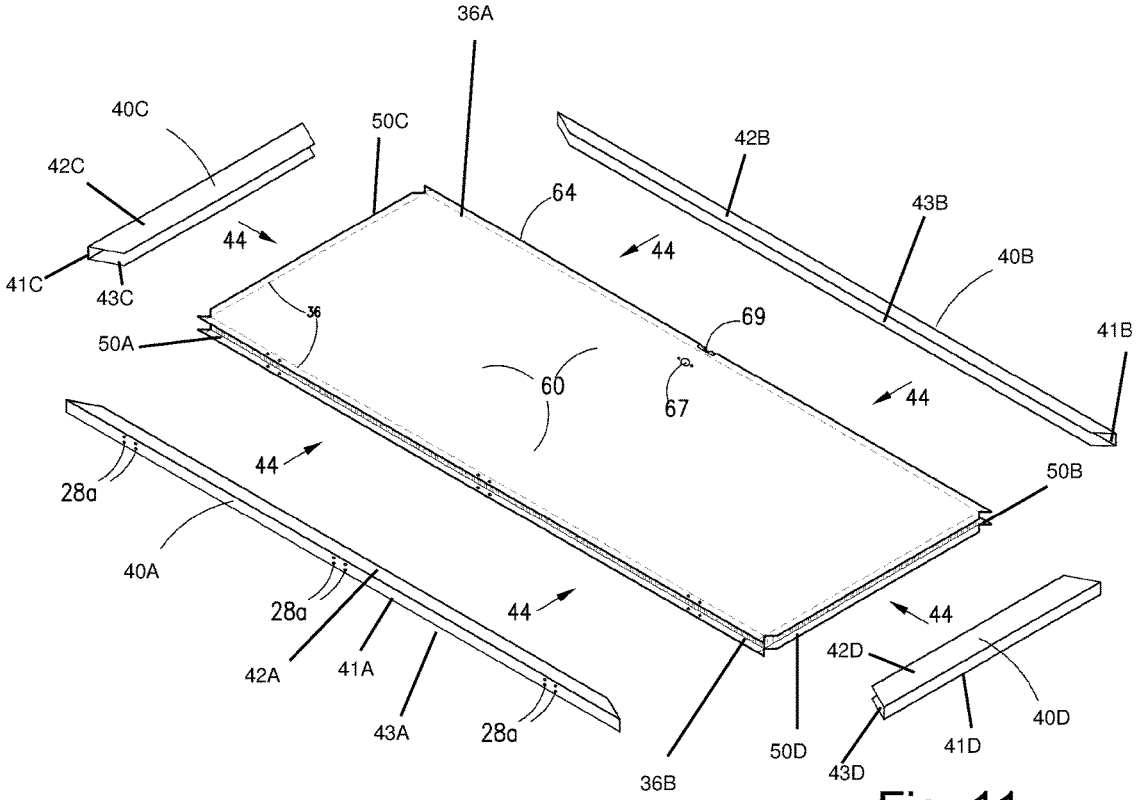
FIG. 11 is an exploded isometric perspective view of the honeycomb core panel and the inner door frame sections.

As best shown in FIG. 11, there is a plurality of inner frame sections 40, the plurality of inner frame sections being comprised of a hinge frame section 40A, a latch frame section 40B, an upper frame section 40C, and a lower frame section 40D. Each inner frame section 40 comprises an elongated C-section beam having a central portion 41, an upper flange 42, and a lower flange 43. In particular, the hinge frame section 40A is comprised of a central hinge portion 41A, a top hinge flange 42A, and a bottom hinge flange 43A in a C-section arrangement with the hinge central portion between the top hinge flange and the bottom hinge flange, the top hinge flange being parallel to the bottom hinge flange in the C-section arrangement. The latch frame section 40B is comprised of a central latch portion 41B, a top latch flange 42B, and a bottom latch flange 43A in a C-section arrangement with the latch central portion between the top latch flange and the bottom latch flange, the top latch flange being parallel to the bottom latch flange in the C-section arrangement. The upper frame section 40C is comprised of a central upper portion 41C, a top upper flange 42C, and a bottom upper flange 43C in a C-section arrangement with the upper central portion between the top upper flange and the bottom upper flange, the top upper flange being parallel to the bottom upper flange in the C-section arrangement. The lower frame section 40D is comprised of a central lower portion 41D, a top lower flange 42D, and a bottom lower flange 43D in a C-section arrangement with the lower central portion between the top lower flange and the bottom lower flange, and the top lower flange being parallel to the bottom lower flange in the C-section arrangement. The door 100 comprises an inner frame section 40 for each edge (hinge edge, latch edge, top and bottom edges) of the honeycomb core panel or sandwhich panel 20, being a hinge frame section 40*a*, a latch frame section 40*b*, a top frame section 40C, and a bottom frame section 40D. The frame sections comprise mitred (45°) cut ends to meet at the corners and together form an internal perimeter frame for the door. The central portion 41 of the hinge frame section 40*a* includes spaced hinge holes 28*a*. The central portion 41 of the hinge latch section 40*b* includes a cutout corresponding to the latch plate cut detail 69.

The inner frame sections 40 are inserted into the respective edges (hinge edge, latch edge, top and bottom edges) of the honeycomb core panel 20, between the inner surfaces 61 and 71 of the first panel 58 and the second panel 59. Sections of the honeycomb core 50 adjacent the inner surfaces 61 and 71 are removed to allow the upper and lower flanges 42 to be inserted therein. The inner frame sections 40 are inserted such that they are disposed inwardly of the respective panel tabs (hinge tabs 62 and 72, latch tabs 64 and 74, upper tabs 66 and 76, and lower tabs 68 and 78). The central portion 41 extends perpendicularly between the first panel 58 and the second panel 59, slightly inwardly of the V-groove fold lines 36.

Figure 5:
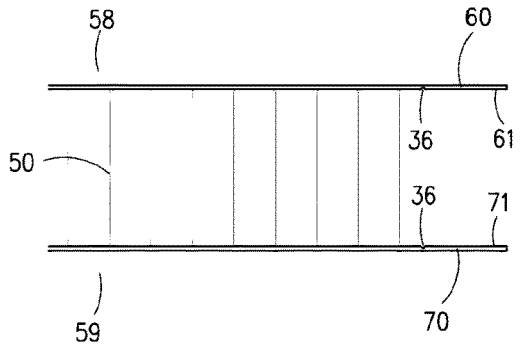
FIGS. 5 to 8 are cross-section views of details of the honeycomb core panel showing the steps in the insertion of the inner frame to the edge section of the core panel and panel folds over the inner frame.
Figure 6:
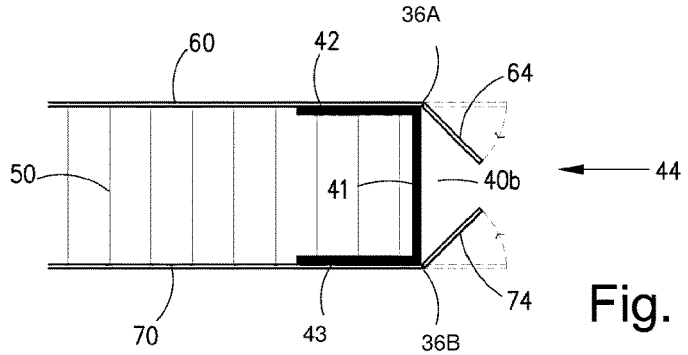
Figure 7:
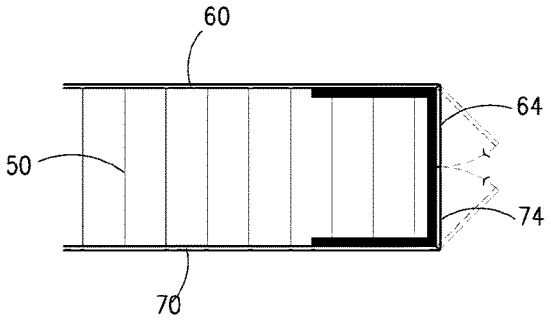

FIGS. 5 to 7 show the insertion of the latch frame section 40*b* to the latch frame edge of the honeycomb core 50. The latch tabs 64 and 74 are then folded towards each other (over and covering the central portion 41, securing latch frame section 40*b* to the honeycomb core 50. These steps are repeated for the other frame sections 40 into their respective edges of the honeycomb core 50.

Figure 8:
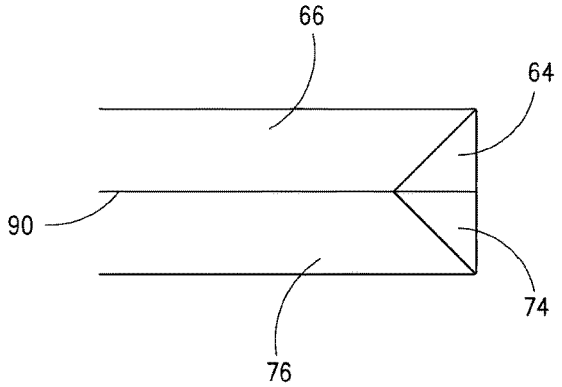

FIG. 8 shows the folded latch tabs 64 and 74 and folded lower tabs 68 and 78. The folded tabs meet at a centre line 90 of the door edges. The triangular cut outs 22 allow the adjacent tabs to meet in a contiguous manner with no overlap.

Figure 9:
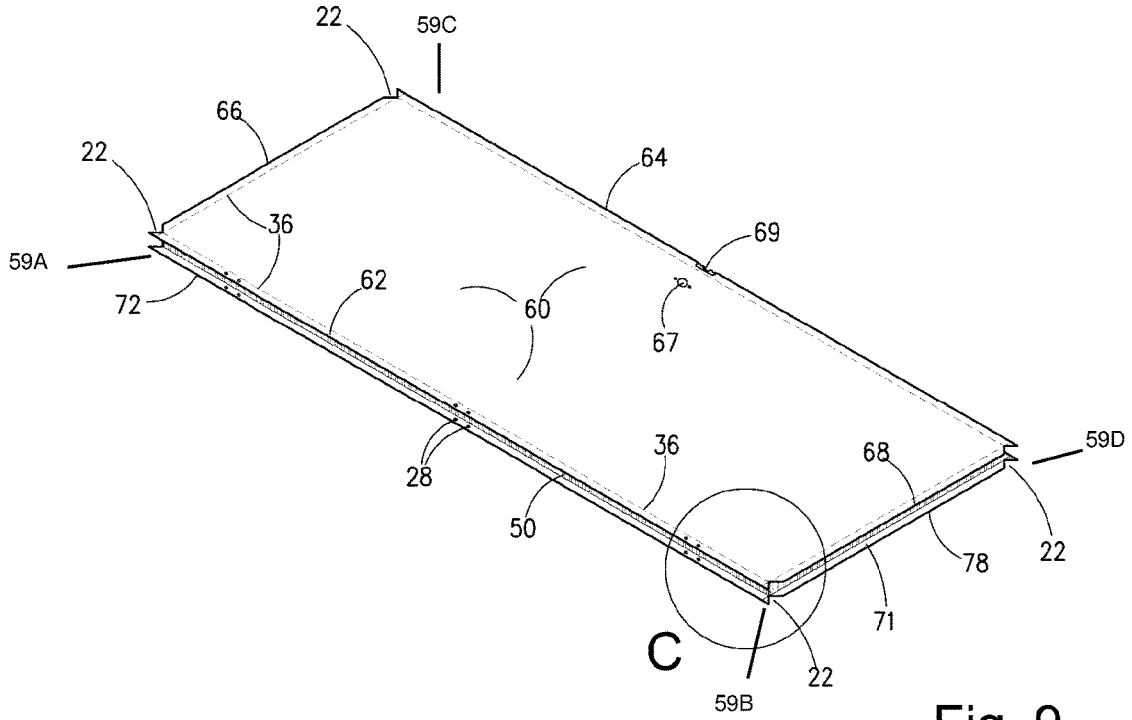
FIG. 9 is an isometric perspective view of the honeycomb core panel.
Figure 10:
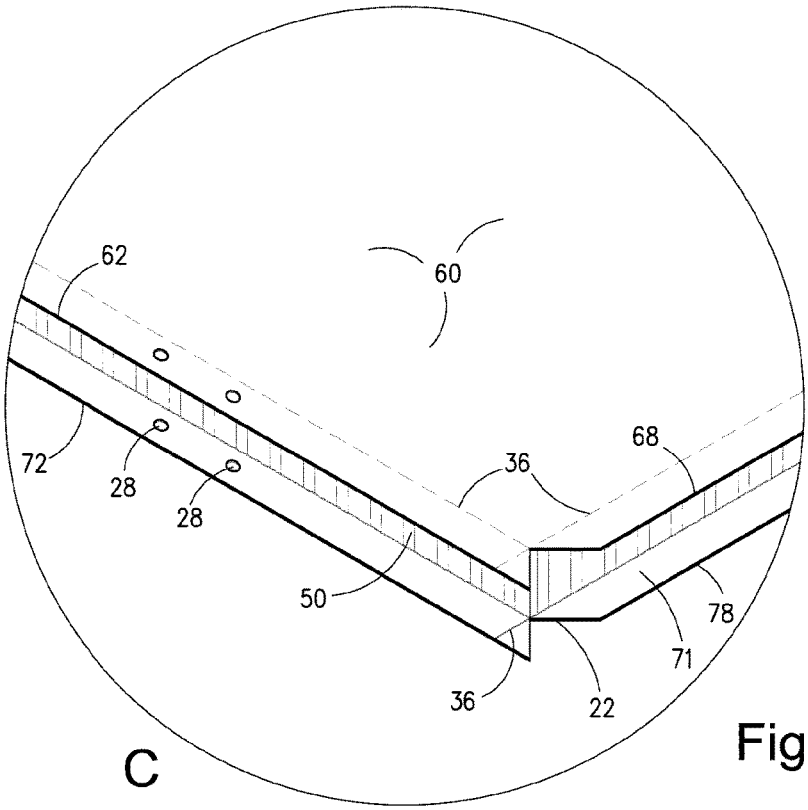
FIG. 10 shows the detailed perspective view of C in FIG. 9 showing the hinge hole locations and corner cuts for folding.

FIGS. 9 and 10 shows the honeycomb core panel 50, including the hinge hole locations 28 and corner cuts 22. Dashed lines 36 represent the 'V shaped folding grooves, mounting holes 67 for the door hardware, latch plate cut out 69 and door hinge holes 28. The cut out portions 22 form the corner tab folds, with folds meeting at the middle 90 of the panel thickness.

FIG. 11 shows the honeycomb core 50 with inner frame sections 40 to be inserted into the honeycomb core 50 by sliding 44 into the open core. When the inner frame sections 40 are in position, upper perimeter tabs 62, 64, 66 and 68 are folded to meet lower perimeter tabs 72, 74, 76 and 78 at the middle 90 of the panel thickness.

Figure 12:
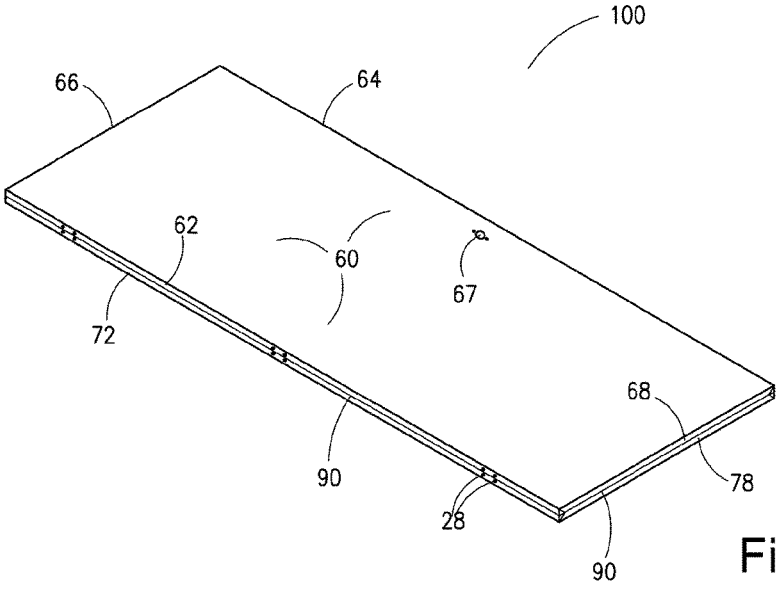
FIG. 12 is an isometric perspective view from the hinge face of the formed door with the folded panels.

FIG. 12 is an isometric view from the hinge face of the formed door 100 with the folded panels.

Figure 13:
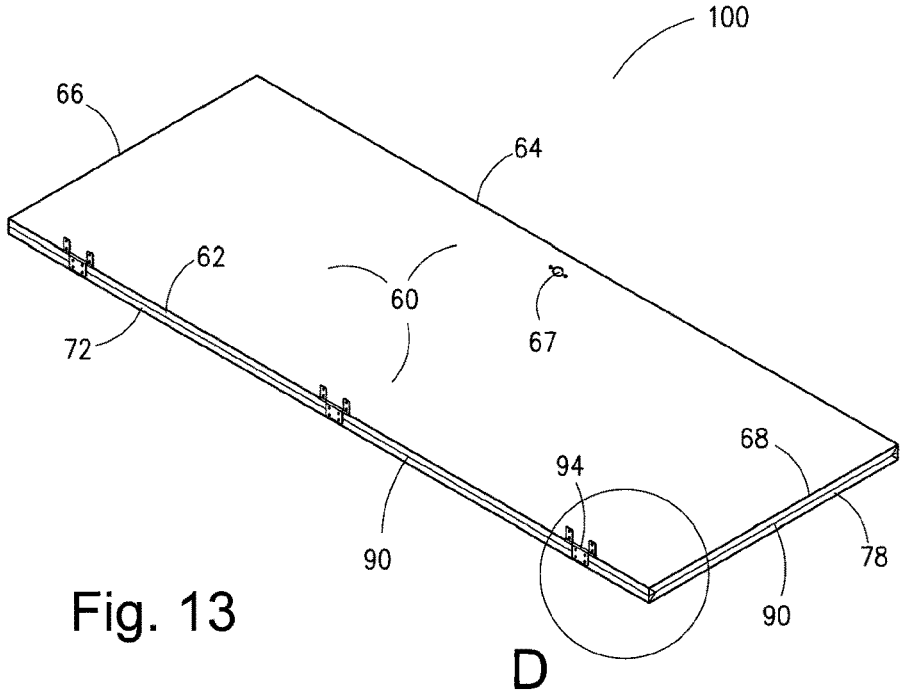
FIG. 13 is an isometric perspective view similar to FIG. 12 with hinges installed to the door.
Figure 14:
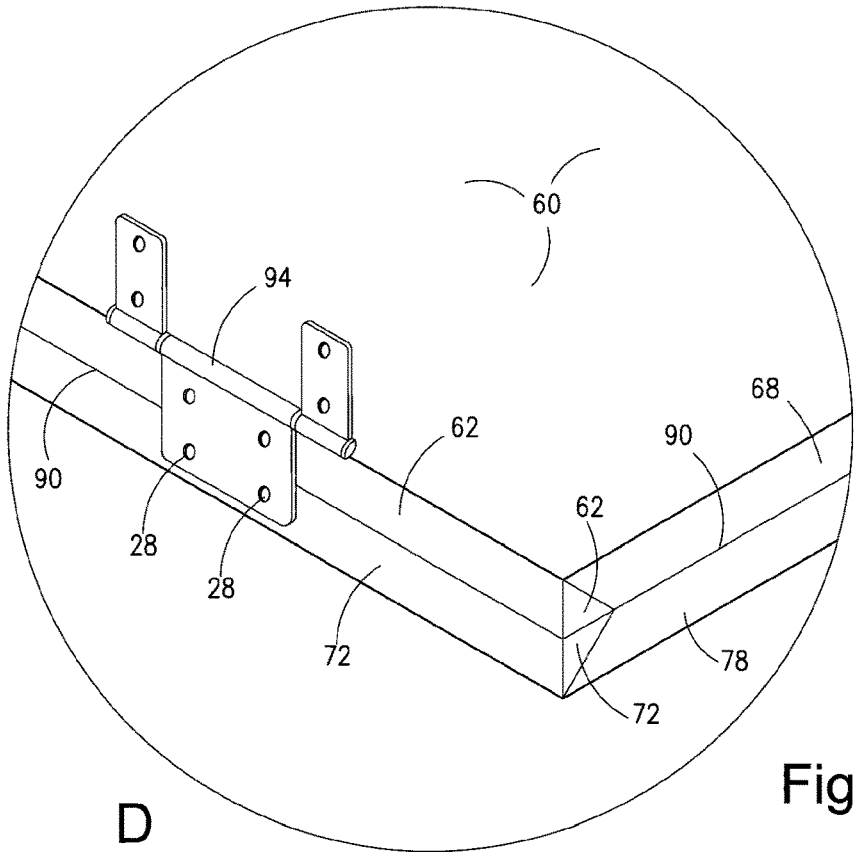
FIG. 14 shows the detailed perspective view of D in FIG. 13.

FIG. 13 is an isometric view similar to FIG. 12 with hinges 94 installed to the door 100. The hinges 94 secure the first hinge tab 62 to the second hinge tab 72, meeting at the middle 90 of the panel thickness. The hinges 94 are also secured to the inner frame section 40*a*.

Figure 15:
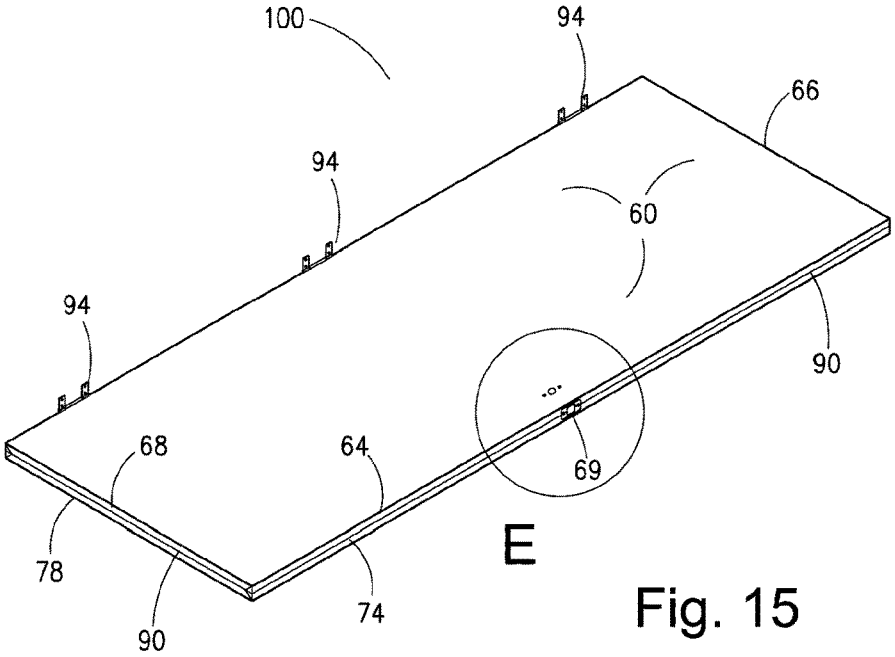
FIG. 15 is an isometric perspective view from the latch face of the formed door.
Figure 16:
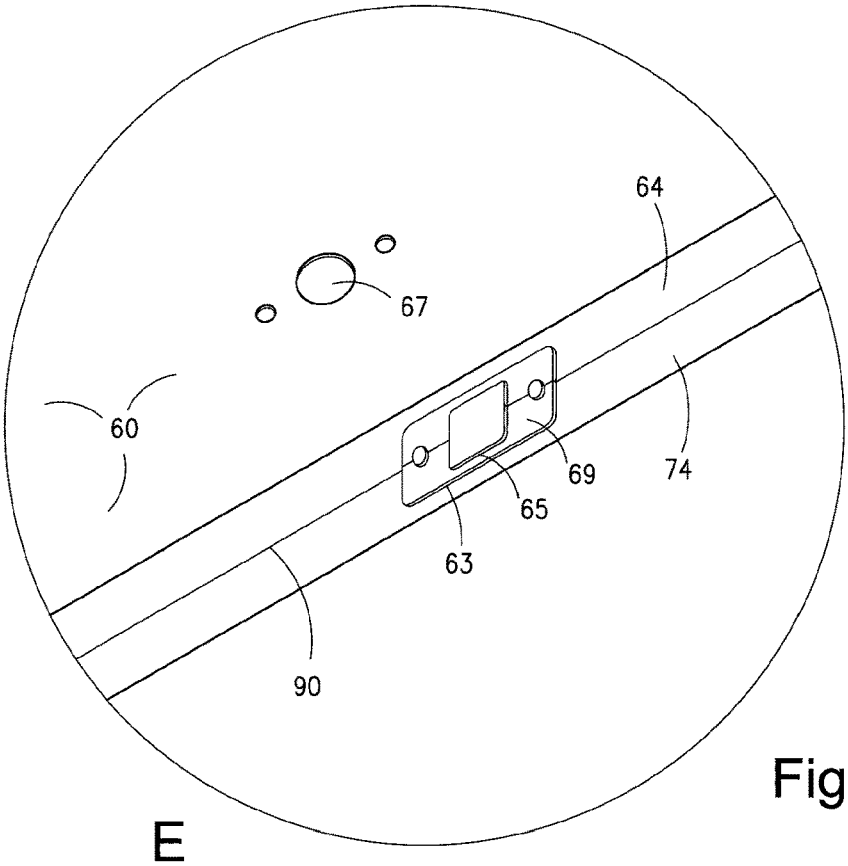
FIG. 16 shows the detailed perspective view of E in FIG. 1.

FIGS. 15 and 16 show isometric views of the door panel 100 with latch plate details 69 being located between first latch tab 64 and the second latch tab 74. The deformation outlines 63 are punched and deformed into both latch tabs 64 and 74 to provide a recess to house a latch plate. The latch plate locks the first and second panels 58 and 59 to the inner frame section 40*b*. The latch cutout openings 65 join to form the opening for the latch.

FIGS. 17 to 20 shows a pre-finished aluminium honeycomb core panel 20*b* for a door 100*b* according to an alternate embodiment of the present invention that incorporates cuts 24 and grooves and an extended second latch tab 74 to be folded for a double rebate door.

Figure 18:
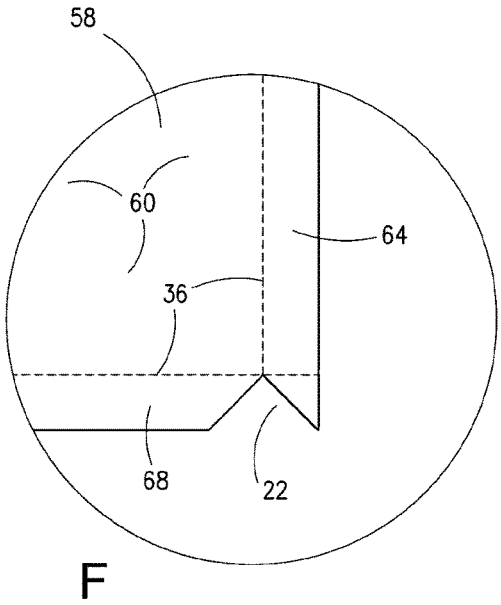
FIG. 18 shows the detailed elevation view of F in FIG. 17 of the first (upper) panel.

FIG. 18 shows the detail F of the first (upper) panel 58, which is similar for the honeycomb core panel 20 above. The first panel 58 includes the upper external surface 60 with corner cut 22 and internal surface 'V grooves 36 for folding lines for the first latch tab 64 and the first lower tab 68.

Figure 20:
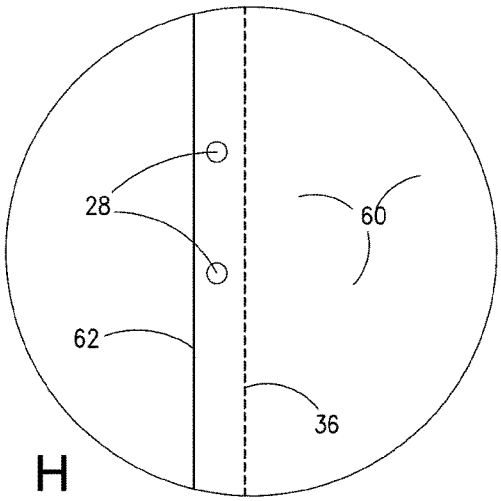
FIG. 20 shows the detailed elevation of H in FIG. 17 of the hinge face.
Figure 19:
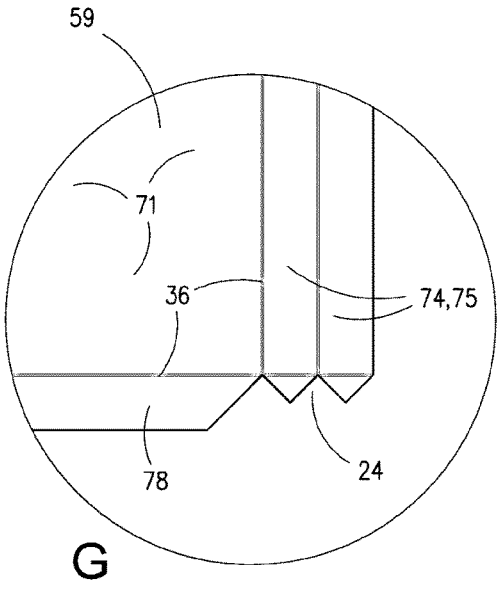
FIG. 19 shows the detailed elevation of G in FIG. 17 of the second (lower) panel.
Figure 21:
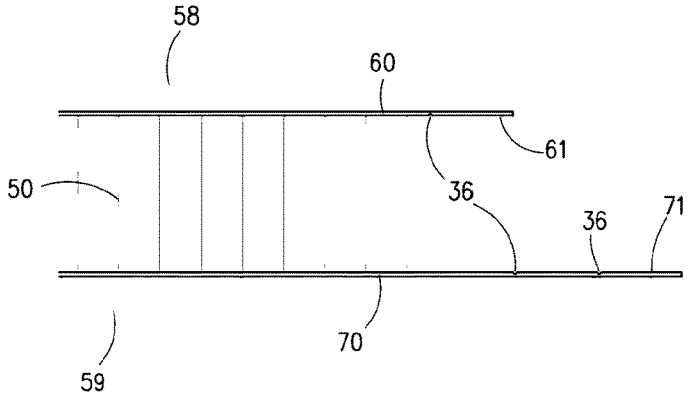
FIGS. 21 to 24 are cross-sectional views of details of the honeycomb core panel of FIG. 17 showing the steps in the insertion of the inner frame to the edge section of the core panel and panel folds over the inner frame.
Figure 22:
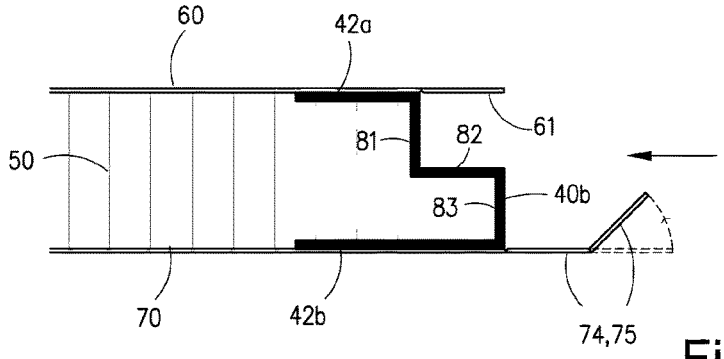
Figure 23:
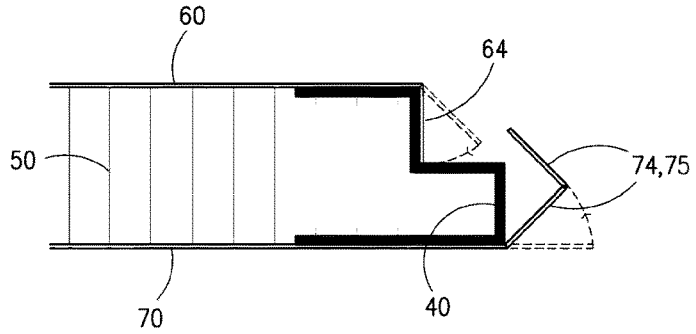

FIG. 19 shows the detail G of the second (lower) panel 59. The lower panel 59 is wider than the first panel 58 as shown in FIG. 21. The internal surface 71 of the lower panel 59 includes two parallel 'V grooves 36 to form the second latch tab 74 and an additional tab 75. The lower panel 59 has an alternate triangular corner cut detail 24 for when folding the second latch tab 74 and the additional tab 75 adjacent the second lower tab 78. FIG. 20 shows the hinge holes 28 located in the first hinge tab 62 with dashed line representing the 'V groove folding guideline 36 in the inner surface 61 of the first panel 58

FIGS. 21 to 24 show the steps in the insertion of the latch frame section 40*c* to the edge section of the honeycomb core panel 20*b*. The other frame sections 40 are the same as for the door 100 above, only the latch frame section 40*c* is different. The latch frame section 40*c* in cross-section comprises a step (rebate) 43 in the central portion 41.

The step 43 is formed by the central portion 41 comprising a first vertical section 81 extending from the upper flange 42*a*, a second horizontal section 82 at a mid-portion, and a third vertical section 83 extending to the lower flange 42*b*. The lower flange 42*b* is thus wider than the upper flange 42*a*.

Figure 24:
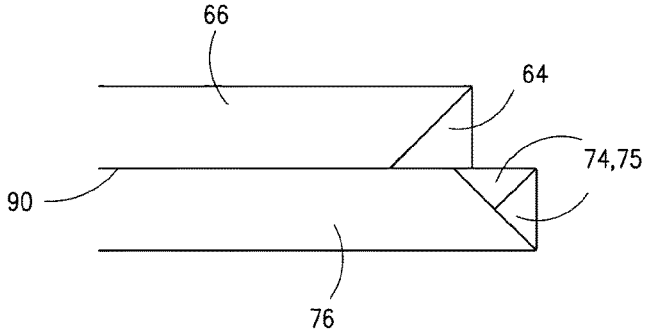

As per above, the frame sections 40 are inserted into the honeycomb core panel 20*b*. For the latch edge, the first latch tab 64 covers the first vertical section 81, the additional tab 75 covers the second horizontal section 82, and the second latch tab 74 covers the third vertical section 83. The folded tabs secure the frame sections 40 to the honeycomb core panel 20*b*. FIG. 24 shows the closed panel folds creating a double rebate door.

Figure 17:
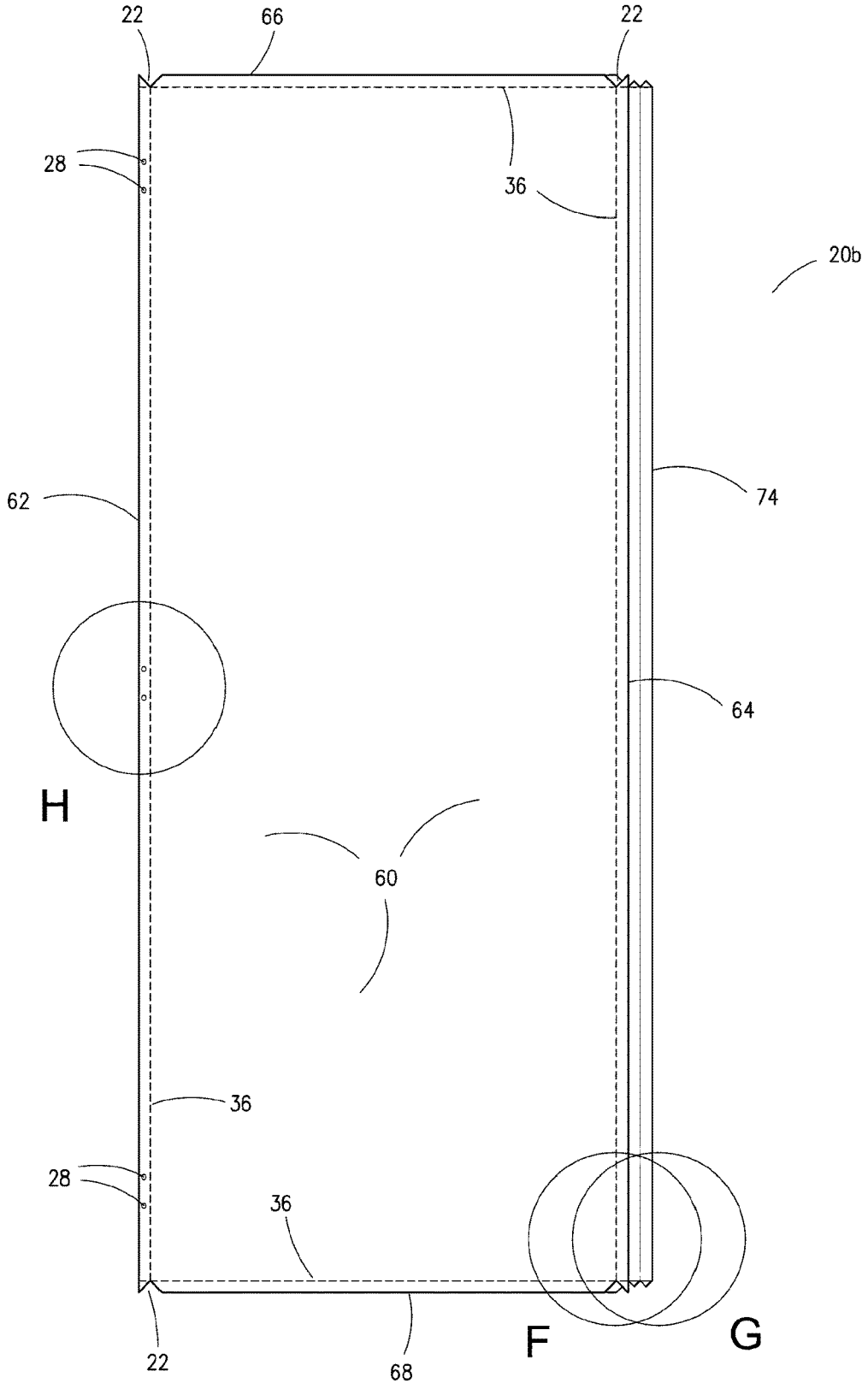
FIG. 17 is a front elevation view of an alternate honeycomb core panel for a double rebate door showing cut and grooved line.
Figure 25:
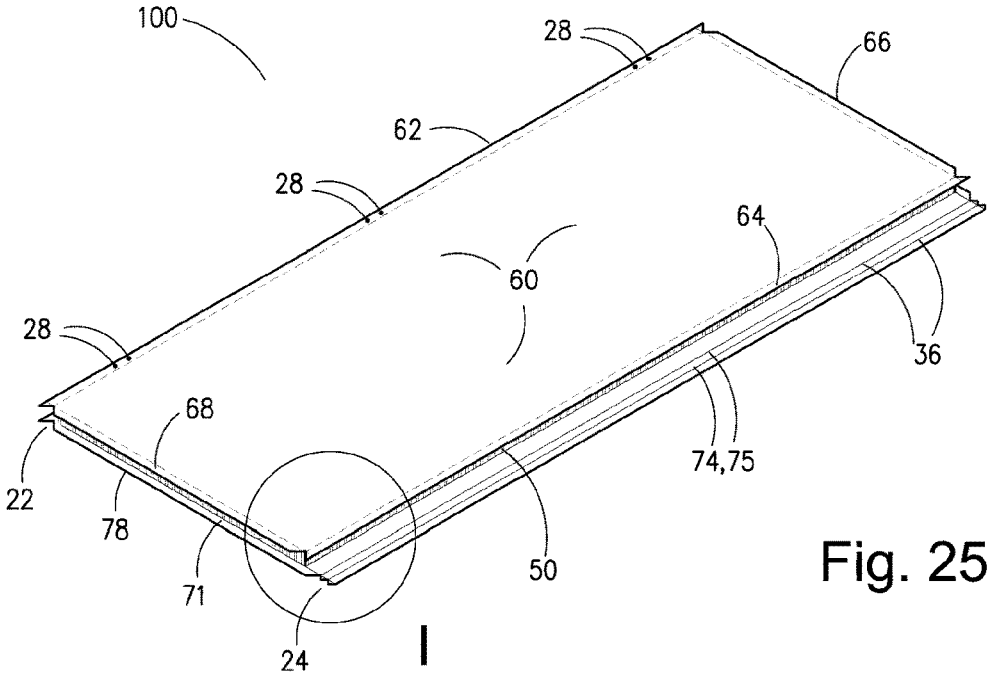
FIG. 25 is an isometric perspective view of the honeycomb core panel of FIG. 17 showing the panel corner cuts.
Figure 26:
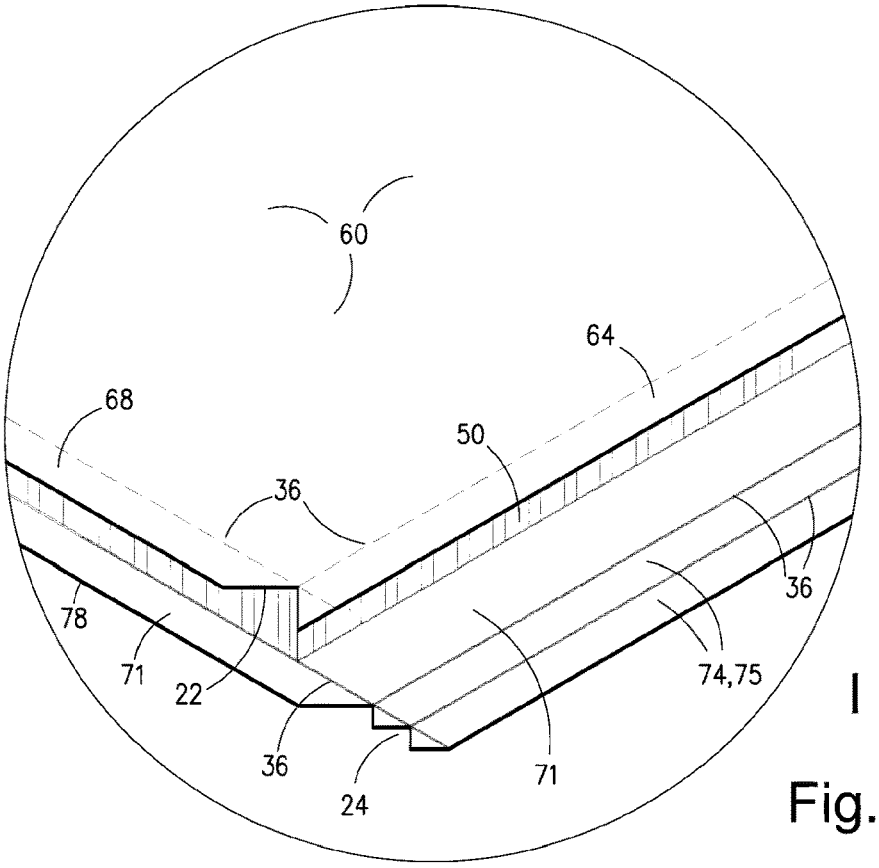
FIG. 26 shows the detailed perspective view of I in FIG. 25.

FIGS. 25 and 26 is an isometric view of the honeycomb core 20*b* of FIG. 17 showing the panel corner cuts and edge tabs. Dashed lines 36 represent the V shaped grooves, door hinge holes 28 with cut out shapes 22 and 24 forming the corner tab folds.

Figure 27:
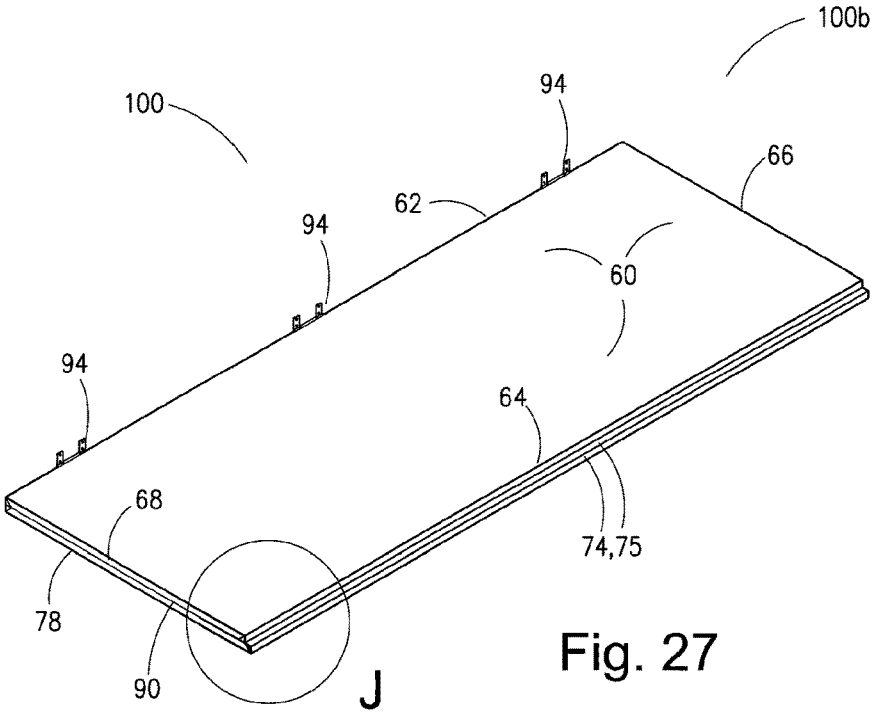
FIG. 27 is an isometric perspective view of the formed alternative door.
Figure 28:
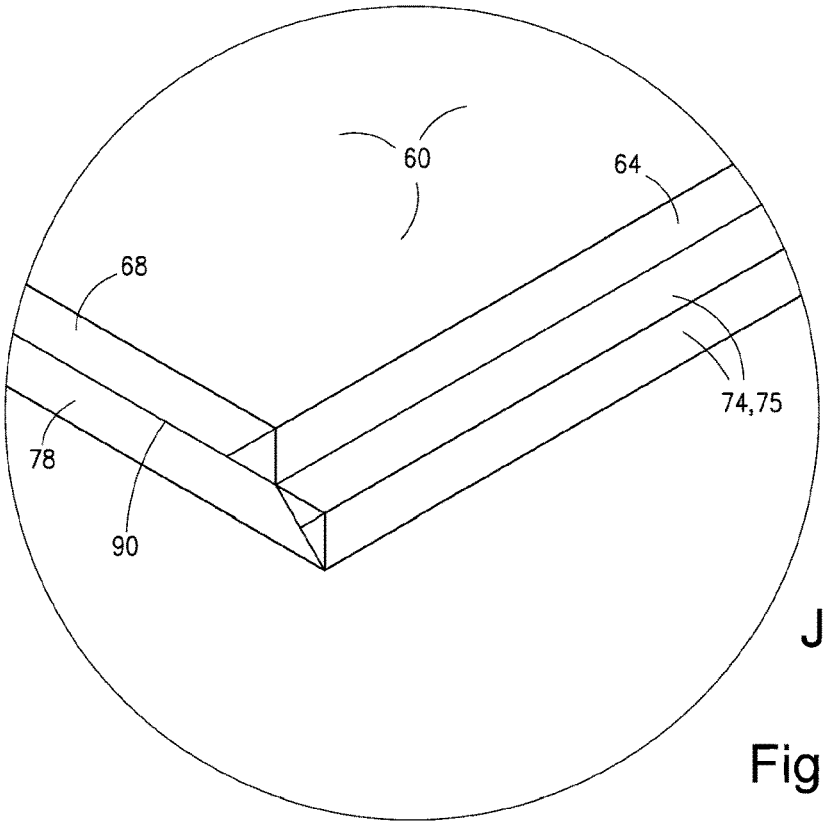
FIG. 28 shows the detailed perspective view of J in FIG. 27.

FIGS. 27 and 28 show the formed alternative door 100*b* with the folded first panel tab 64 meeting with second panel tabs 74 and 75 creating a double rebate door, with folds meeting at the middle 90 of the panel thickness.

The present invention provides an improvement on the conventional door construction by using a prefabricated and pre-finished honeycomb core panel that is cut and V grooved with folded edges that form a substantially seamless door.

The present invention allows for doors to be completely manufactured on a CNC Computer Numerically Controlled machine ensuring greatest efficiency and accuracy.

The present invention also allows for very large doors of high strength that are capable of having a different colour or texture on the inside and outside.

The present invention provides an extremely lightweight door relative to the size due to the nature of material technology.

There are many possible alternative embodiments to the present invention.

The present embodiment provides a door that is formed entirely out of a pre-fabricated and pre-finished single panel of aluminium honeycomb core panel. The honeycomb panel is cut and grooved in such a way to accept an inner frame for structural strength, with edges being folded to lock onto the inner frame.

Whilst preferred embodiments of the present invention have been described, it will be apparent to skilled persons that modifications can be made to the embodiments made.

The panel can alternatively be made from stainless steel or other metal sheet, with an alternate core other than a honeycomb core. As a further alternative, the panel can be made from plastics material core between two sheets of other metals.

The preferred embodiment provides the following advantages:

Completely pre-finished door manufactured from a pre-fabricated material

A door manufactured from a single aluminium honeycomb core panel

Capable of having two different colours and textures inside and outside

Very large up to 2.0 m×4.0 m doors that are high strength

Extremely lightweight doors in comparison to size.

Great thermal properties

Will not swell of distort

Manufacturing process on computer numerical control CNC machine.

According to a first aspect, the present invention provides a door comprising a prefabricated single honeycomb core aluminium panel, such that thickness of the honeycomb panel equals the thickness of the door required.

In a preferred embodiment, the pre-fabricated honeycomb core is sandwiched between upper and lower pre-finished aluminium sheets.

In another preferred embodiment, the pre-fabricated honeycomb core panel comprises edge tabs that are folded from the upper and lower faces respectively, folded to encompass the external door perimeter.

In another preferred embodiment, the pre-fabricated panel is substantially rigid and comprises grooves formed into the inner surface of the upper and lower panels, with grooves being spaced by a distance equal to half width of the panel.

In another preferred embodiment, V grooves are carved into the inner surface of the upper and lower panels, providing a folding guideline and control the folding radius.

In another preferred embodiment, the upper face and lower face folded sections meet at the middle of the panel thickness, and encompass the perimeter of the entire panel.

In another preferred embodiment, the upper and lower corners comprise of triangular cuts at such an angle that the adjacent tabs are substantially contiguous when folded.

In another preferred embodiment, the panel further comprises an inner aluminium frame which is inserted by sliding into the perimeter of the honeycomb core panel from the side.

In another preferred embodiment, the upper and lower panel folds are secured to the inner aluminium door frame section via the hinges that lock the frame to the upper and lower external faces and provide structural strength to the door.

In another preferred embodiment, the panel further comprises at least one flush mount hinge that is screwed into the inner aluminium frame to lock the upper and lower folds with the inner aluminium door frame.

In another preferred embodiment, the panel comprises additional grooves formed in the inner surface along lines parallel to and inwardly spaced from edges of the panel to form side, upper and lower edge tabs which are folded towards each other to form the latch, hinge, upper and lower faces of the door respectively.

In another preferred embodiment, the door comprises of one of the main faces being wider that the other, the wider main face comprising two adjacent edge tabs.

In another preferred embodiment, the two adjacent edge tabs are folded such to form a double rebate at the latch face.

In another preferred embodiment, the honeycomb core aluminium panel door is sufficiently rigid to accept a glass insert panel, and as such can be used for feature doors and front entry doors.

In another preferred embodiment, the external sheets are stainless steel.

In another aspect, the invention provides a door comprising of a single pre-fabricated aluminium honeycomb core panel that is of required door thickness, having upper and lower surfaces that are cut with triangular tabs, V grooved and edge folded to form a pre-finished door with fully enclosed edges.

In another preferred embodiment, the door can be made a much larger size up to 2.0 meters×4.0 meters and is super strong due to pre-fabricated nature of material used.

In another preferred embodiment, the door is extremely lightweight in comparison to conventional doors of equivalent size and strength.

In another preferred embodiment, the door has factory pre-finishing with nano technology and is capable of having the outside surface colour and or texture totally different to the inside surface colour and or texture, whereas the edge folds meet at the middle of the thickness of the door.

In another preferred embodiment, the door is completely waterproof, will not swell or distort, and has great thermal properties.

The invention provides a means for a completely pre-finished door to be manufactured from a pre-fabricated aluminium honeycomb core panel. The relatively lightweight honeycomb panel is manufactured with pre-finished upper and lower faces, having the advantage that each face can be finished in a different colour or texture for inside and outside use.

In a possible modification, the flanges of the frame sections can be omitted. The central section of the frame sections can alternatively comprise hollow sections such as rectangular hollow sections.

I claim:

1. A door comprising:

a sandwich panel comprising:

a first panel having a first external surface and a first inner surface, wherein said first inner surface is comprised of a first V-shaped groove so as to define a plurality of first edge tabs, said first edge tabs being in hinged relationship to said first external surface, said plurality of first edge tabs being comprised of a first hinge tab, a first latch tab, a first upper tab, and a first lower tab, wherein said first panel has a corner between said first hinge tab and said first upper tab, a corner between said first hinge tab and said first lower tab, a corner between said first latch tab and said first upper tab, and a corner between said first latch tab and said first lower tab, each corner of said first panel having a triangle cut, wherein said first hinge tab is comprised of a plurality of first pairs of hinge holes;

a second panel having a second external surface and a second inner surface, said first inner surface facing said second inner surface, wherein said second inner surface is comprised of a second V-shaped groove so as to define a plurality of second edge tabs, said second edge tabs being in hinged relationship to said second external surface to said first inner surface, said first edge tabs being in hinged relationship to said first external surface toward said second inner surface, said plurality of second edge tabs being comprised of a second hinge tab, a second latch tab, a second upper tab, and a second lower tab, wherein said second panel has a corner between said second hinge tab and said second upper tab, a corner between said second hinge tab and said second lower tab, a corner between said second latch tab and said second upper tab, and a corner between said second latch tab and said second lower tab, each corner of said second panel having a triangle cut, wherein said second hinge tab is comprised of a plurality of second pairs of hinge holes; and a honeycomb core extending between said first inner surface 61 and said second inner surface and having a plurality of edge sections, said plurality of edge sections being comprised of a hinge edge section, a latch edge section, an upper edge section, and a lower edge section; and a plurality of inner frame sections, said plurality of inner frame sections being comprised of a hinge frame section, a latch frame section, an upper frame section, and a lower frame section, wherein each inner frame section is comprised of a central portion, a top flange, and a bottom flange in a C-section arrangement with said central portion between said top flange and said bottom flange, said top flange being parallel to said bottom flange in said C-section arrangement, wherein said hinge frame section is comprised of a central hinge portion, a top hinge flange, and a bottom hinge flange in a C-section arrangement with said hinge central portion between said top hinge flange and said bottom hinge flange, said top hinge flange being parallel to said bottom hinge flange in said C-section arrangement, wherein said latch frame section is comprised of a central latch portion, a top latch flange, and a bottom latch flange in a C-section arrangement with said latch central portion between said top latch flange and said bottom latch flange, said top latch flange being parallel to said bottom latch flange in said C-section arrangement, wherein said upper frame section is comprised of a central upper portion, a top upper flange, and a bottom upper flange in a C-section arrangement with said upper central portion between said top upper flange and said bottom upper flange, said top upper flange being parallel to said bottom upper flange in said C-section arrangement, wherein said lower frame section is comprised of a central lower portion, a top lower flange, and a bottom lower flange in a C-section arrangement with said lower central portion between said top lower flange and said bottom lower flange, said top lower flange being parallel to said bottom lower flange in said C-section arrangement, wherein said hinge frame section is mounted on said hinge edge section between said first panel and said second panel, said central hinge portion being fit to said hinge edge section and being aligned with said first hinge tab and said second hinge tab, said first hinge tab being in a folded configuration over said central hinge portion toward said second hinge tab, said second hinge tab being in a folded configuration over said central hinge portion toward said first hinge tab, said first hinge tab being flush with said second hinge tab over said central hinge portion so as to form a hinge face, each first pair of hinge holes on said first hinge tab is aligned with a respective second pair of hinge holes on said second hinge tab, wherein said latch frame section is mounted on said latch edge section between said first panel and said second panel, said central latch portion being fit to said latch edge section and being aligned with said first latch tab and said second latch tab, said first latch tab being in a folded configuration over said central latch portion toward said second latch tab, said second latch tab being in a folded configuration over said central latch portion toward said first latch tab, said first latch tab being flush with said second latch tab over said central latch portion so as to form a latch face, wherein said upper frame section is mounted on said upper edge section between said first panel and said second panel, said central upper portion being fit to said upper edge section and being aligned with said first upper tab and said second upper tab, said first upper tab being in a folded configuration over said central upper portion toward said second upper tab, said second upper tab being in a folded configuration over said central upper portion toward said first upper tab, said first upper tab being flush with said second upper tab over said central upper portion so as to form an upper face, and wherein said lower frame section is mounted on said lower edge section between said first panel and said second panel, said central lower portion being fit to said lower edge section and being aligned with said first lower tab and said second lower tab, said first lower tab being in a folded configuration over said central lower portion toward said second lower tab, said second lower tab being in a folded configuration over said central lower portion toward said first lower tab, said first lower tab being flush with said second lower tab over said central lower portion so as to form a lower face.

2. The door of claim 1, wherein said central hinge portion extends perpendicularly between said first panel and said second panel, wherein said central hinge portion extends perpendicularly between said first panel and said second panel, wherein said central upper portion extends perpendicularly between said first panel and said second panel, and wherein said central lower portion extends perpendicularly between said first panel and said second panel.

3. The door of claim 1, wherein each inner frame section is further comprised of mitred cut ends, said hinge frame section and said upper frame section being connected at said corner between said first hinge tab and said first upper tab, said hinge frame section and said lower frame section being connected at said corner between said first hinge tab and said first lower tab, said latch frame section and said upper frame section being connected at said corner between said first latch tab and said first upper tab, and said latch frame section and said lower frame section being connected at said corner between said first latch tab and said first lower tab so as to form an inner perimeter frame.

4. The door of claim 1, wherein said first hinge tab is flush with said second hinge tab over said central hinge portion at a center line between said first panel and said second panel, wherein said first latch tab is flush with said second latch tab over said central latch portion at said center line between said first panel and said second panel, wherein said first upper tab is flush with said second upper tab over said central upper portion at said center line between said first panel and said second panel, and wherein said first lower tab is flush with said second lower tab over said central lower portion at said center line between said first panel and said second panel.

5. The door of claim 1, wherein said first latch tab is comprised of first latch deformation outlines and a first latch cutout opening, wherein said second latch tab is comprised of second latch deformation outlines and a second latch cutout opening, said first latch cutout opening being aligned with said second latch cutout opening so as to form a recess for a latch plate.

6. The door of claim 1, further comprising:

a plurality of hinges, each hinge being mounted to a corresponding set of a first pair of hinge holes and a second pair of hinge holes.

7. A method of forming a door, the method comprising the steps of:

providing a sandwich panel comprising:

a first panel having a first external surface and a first inner surface, wherein said first inner surface is comprised of a first V-shaped groove so as to define a plurality of first edge tabs, said first edge tabs being in hinged relationship to said first external surface, said plurality of first edge tabs being comprised of a first hinge tab, a first latch tab, a first upper tab, and a first lower tab, wherein said first panel has a corner between said first hinge tab and said first upper tab, a corner between said first hinge tab and said first lower tab, a corner between said first latch tab and said first upper tab, and a corner between said first latch tab and said first lower tab, each corner of said first panel having a triangle cut, wherein said first hinge tab is comprised of a plurality of first pairs of hinge holes;

a second panel having a second external surface and a second inner surface, said first inner surface facing said second inner surface, wherein said second inner surface is comprised of a second V-shaped groove so as to define a plurality of second edge tabs, said second edge tabs being in hinged relationship to said second external surface to said first inner surface, said first edge tabs being in hinged relationship to said first external surface toward said second inner surface, said plurality of second edge tabs being comprised of a second hinge tab, a second latch tab, a second upper tab, and a second lower tab, wherein said second panel has a corner between said second hinge tab and said second upper tab, a corner between said second hinge tab and said second lower tab, a corner between said second latch tab and said second upper tab, and a corner between said second latch tab and said second lower tab, each corner of said second panel having a triangle cut, wherein said second hinge tab is comprised of a plurality of second pairs of hinge holes; and a honeycomb core extending between said first inner surface and said second inner surface and having a plurality of edge sections, said plurality of edge sections being comprised of a hinge edge section, a latch edge section, an upper edge section, and a lower edge section;

inserting a plurality of inner frame sections between said first panel and said second panel, said plurality of inner frame sections being comprised of a hinge frame section, a latch frame section, an upper frame section, and a lower frame section, wherein each inner frame section is comprised of a central portion, a top flange, and a bottom flange in a C-section arrangement with said central portion between said top flange and said bottom flange, said top flange being parallel to said bottom flange in said C-section arrangement, wherein said hinge frame section is comprised of a central hinge portion, a top hinge flange, and a bottom hinge flange in a C-section arrangement with said hinge central portion between said top hinge flange and said bottom hinge flange, said top hinge flange being parallel to said bottom hinge flange in said C-section arrangement, wherein said latch frame section is comprised of a central latch portion, a top latch flange, and a bottom latch flange in a C-section arrangement with said latch central portion between said top latch flange and said bottom latch flange, said top latch flange being parallel to said bottom latch flange in said C-section arrangement, wherein said upper frame section is comprised of a central upper portion, a top upper flange, and a bottom upper flange in a C-section arrangement with said upper central portion between said top upper flange and said bottom upper flange, said top upper flange being parallel to said bottom upper flange in said C-section arrangement, wherein said lower frame section is comprised of a central lower portion, a top lower flange, and a bottom lower flange in a C-section arrangement with said lower central portion between said top lower flange and said bottom lower flange, said top lower flange being parallel to said bottom lower flange in said C-section arrangement, wherein the step of inserting is comprised of:

removing a portion of said honeycomb core so as to fit said central hinge portion to said hinge edge section;

mounting said hinge frame section on said hinge edge section;

folding said first hinge tab over said central hinge portion toward said second hinge tab; and folding said second hinge tab over said central hinge portion toward said first hinge tab, said first hinge tab being flush with said second hinge tab over said central hinge portion so as to form a hinge face, each first pair of hinge holes on said first hinge tab is aligned with a respective second pair of hinge holes on said second hinge tab, wherein the step of inserting is further comprised of:

removing a portion of said honeycomb core so as to fit said central latch portion to said latch edge section;

mounting said latch frame section on said latch edge section;

folding said first latch tab over said central latch portion toward said second latch tab; and folding said second latch tab over said central latch portion toward said first latch tab, said first latch tab being flush with said second latch tab over said central latch portion so as to form a latch face, wherein the step of inserting is further comprised of:

removing a portion of said honeycomb core so as to fit said central upper portion to said upper edge section;

mounting said upper frame section on said upper edge section;

folding said first upper tab over said central upper portion toward said second upper tab; and folding said second upper tab over said central upper portion toward said first upper tab, said first upper tab being flush with said second upper tab over said central upper portion so as to form an upper face, and wherein the step of inserting is further comprised of:

removing a portion of said honeycomb core so as to fit said central lower portion to said lower edge section;

mounting said lower frame section on said lower edge section;

folding said first lower tab over said central lower portion toward said second lower tab; and folding said second lower tab over said central lower portion toward said first lower tab, said first lower tab being flush with said second lower tab over said central lower portion so as to form a lower face.

* * * * *